US005802627A

United States Patent [19]

Yeung

[11] Patent Number: 5,802,627

[45] Date of Patent: Sep. 8, 1998

[54] FLUID OPERATED TILTING BOWL TOILET

[76] Inventor: Shu-Ki Yeung, 936 White Street, Saint-Laurent, Quebec H4M 2W6, Canada

[21] Appl. No.: 693,084

[22] PCT Filed: Feb. 28, 1995

[86] PCT No.: PCT/CA95/00121

§ 371 Date: Aug. 8, 1996

§ 102(e) Date: Aug. 8, 1996

[87] PCT Pub. No.: WO95/23261

PCT Pub. Date: Aug. 31, 1995

[30] Foreign Application Priority Data

Feb. 28, 1994 [GB] United Kingdom ..... 9403776
Mar. 1, 1994 [CA] Canada ..... 2101913

[51] Int. Cl.[6] ..... E03D 11/10

[52] U.S. Cl. ..... 4/313; 4/442

[58] Field of Search ..... 4/303, 313, 434, 4/437, 438, 440, 441, 442

[56] References Cited

U.S. PATENT DOCUMENTS 3,939,500 2/1976 Miller et al. ..... 4/332
3,949,431 4/1976 Morgan ..... 4/440
4,246,666 1/1981 Stansbury, Jr. ..... 4/438

FOREIGN PATENT DOCUMENTS 2631215 1/1978 Germany .
0017863 8/1892 United Kingdom ..... 4/442

OTHER PUBLICATIONS

International Search Report; PCT/CA95/00121; Francoise Ide.

*Primary Examiner*—Robert M. Fetsuga

[57] ABSTRACT

A toilet including a frame defining a chamber, a toilet bowl disposed within the chamber between an upper and a lower chamber region, and a tilting bowl in the lower chamber region of the frame. The toilet bowl has a lower discharge opening in communication between the upper and lower chamber regions. The tilting bowl defines a fluid-receiving volume, and is mounted for pivoting movement relative to the toilet bowl between a first position with the fluid-receiving volume at least partially overlapping the toilet bowl and containing the lower discharge opening, and a second position permitting flow of fluid from the toilet bowl, through the lower discharge opening, and from the fluid-receiving volume into the lower chamber region. At standby, the tilting bowl, in first position, retains a first volume of fluid sufficient to engage the lower discharge opening and restrict flow of gas therethrough. In response to supply water, the tilting bowl starts to tilt to discharge its content when the volume of fluid reaches a predetermined weight or fluid level.

14 Claims, 12 Drawing Sheets

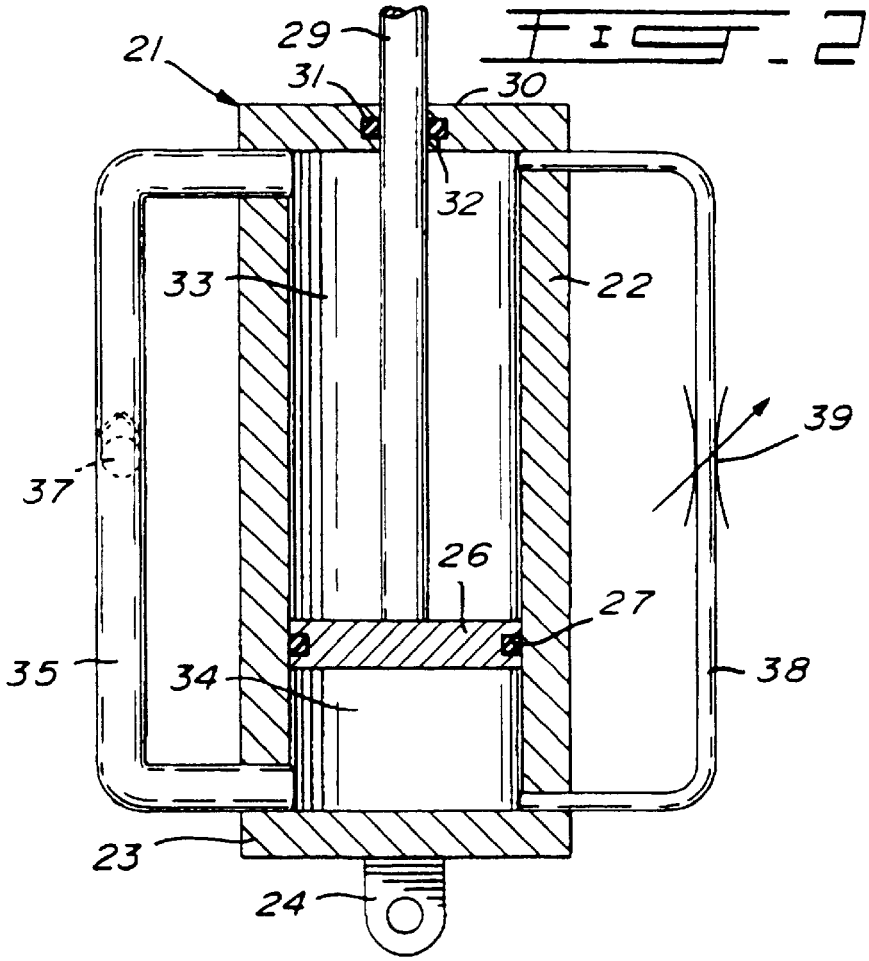
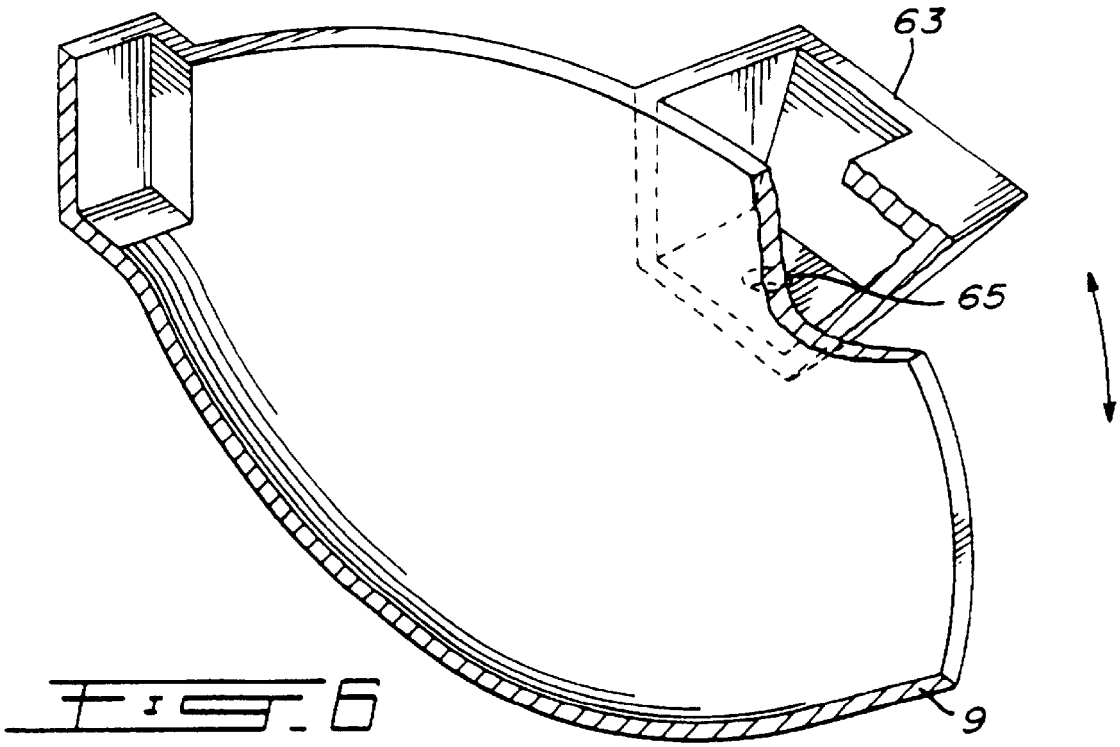
FIG. 6

FLUID OPERATED TILTING BOWL TOILET

This is a National Phase of International Patent Application No. PCT/CA95/00121, with an international filing date of Feb. 28, 1995, now abandoned.

BACKGROUND OF THE INVENTION

1. Field of the Invention

The present invention relates to a new type of toilet comprising no siphon.

2. Brief Description of the Prior Art

Most of the toilets presently in operation and available on the market are flushing toilets comprising a bowl and a siphon to evacuate waste water from the toilet bowl.

A major drawback of these conventional toilets is that they require a water tank or a water pump to create a fairly high pressure for cleaning the toilet bowl and discharging the waste water through the siphon.

OBJECTS OF THE INVENTION

An object of the present invention is therefore to eliminate the above mentioned drawback of the prior art by providing a toilet comprising no siphon. A related object is therefore to provide a toilet which uses less water and is less noisy than conventional toilets. Another related object is to provide a space saving by eliminating the requirement for a water tank or a water pump.

A further object of the present invention is to provide a toilet comprising a cup to hold a required level of water in the toilet bowl, this cup tilting to discharge waste water from the toilet bowl.

Another object of the invention is to provide an autodisinfecting toilet seat apparatus and a toilet seat apparatus which automatically dispenses toilet seat sanitary cover sheets.

SUMMARY OF THE INVENTION

More particularly, in accordance with the present invention, there is provided a toilet comprising:

a frame supporting a toilet bowl formed with a waste water bottom discharge opening, this frame defining a hollow chamber situated under the toilet bowl and formed with a waste water bottom discharge hole;

a tilting cup means mounted in the hollow chamber under the toilet bowl to extend over the bottom discharge opening of the toilet bowl; and a tilt control system for controlling tilting movement of the cup means between a first position in which the cup means is not tilted to contain water which is communicated to the toilet bowl through the bottom discharge opening, and a second position in which the cup means is tilted to discharge waste water from both the cup and the toilet bowl in the hollow chamber to finally evacuate this waste water through the discharge bottom hole.

As a tilting cup is provided, a siphon is no longer required and the drawback associated to the siphon as discussed hereinabove is thereby eliminated.

In accordance with preferred embodiments of the toilet according to the present invention:

the cup means comprises a one piece cup pivotally mounted about a generally horizontal axis;

the cup means comprises two complementary cup portions of which at least one is pivotally mounted about a given axis to tilt about this axis;

the toilet comprises means for triggering the tilt control system, the tilt control system comprises means responsive to the triggering means for tilting the cup means from the first position to the second position to discharge the waste water from both the cup means and the toilet bowl in the hollow chamber and means for subsequently returning the cup means from the second position to the first position, and the toilet comprises a water supply system itself including means for supplying water to the toilet bowl as the cup means is tilting to clean the toilet bowl and the cup means and means for supplying water to the toilet bowl as the cup means returns from the second position to the first position and/or when the cup means has returned to the first position to raise the water in the toilet bowl to a predetermined level;

the water in the toilet bowl is initially at a first lower level, the toilet further comprises a water supply system for supplying water to the toilet bowl and means for triggering the water supply system for supplying water to the toilet bowl in order to raise the water in the toilet bowl from the first lower level to a second higher level, the tilt control system comprises means responsive to the second higher level of water for tilting the cup means from the first position to the second position to discharge the waste water from both the cup means and the toilet bowl in the hollow chamber and means for returning the cup means from the second position to the first position, and the water supply system comprises means for supplying water to the toilet bowl as the cup means is tilting to clean the toilet bowl and the cup means and means for supplying water to the toilet bowl as the cup means returns from the second position to the first position and/or when the cup means has returned to the first position to raise the water in the toilet bowl to the first lower level;

the means for returning the cup means from the second position to the first position comprises means for retarding a pivotal movement of the cup means from the second position to the first position to enable adequate cleaning of the toilet bowl and the cup means;

the means for supplying water to the toilet bowl as the cup means is tilting comprises a plurality of nozzles for producing respective water jets projected onto the inner wall surfaces of the toilet bowl and the cup means so as to efficiently clean the toilet bowl and the cup means;

the toilet comprises an annular seat with a top surface and a pivotal cover having a bottom face, and the pivotal cover comprises means for holding a supply of pre-shaped seat-covering sheets and means for placing one by one the pre-shaped seat-covering sheets on the top surface of the annular seat by simply applying the pivotal cover to the annular seat;

the bottom face of the pivotal cover is formed with a shallow recess for containing a stack of the pre-shaped seat-covering sheets;

the stack comprises a pre-shaped seat-covering sheet having an exposed surface provided with adhesive means to adhere the exposed surface of the pre-shaped seat-covering sheet to the top surface of the seat upon applying the pivotal cover to the annular seat;

each pre-shaped seat-covering sheet has a plurality of flaps, and the cover comprises means for fastening the flaps in the shallow recess, each flap being separated from the corresponding pre-shaped seat-covering sheet by a tear line whereby when the pivotal cover is moved away from the annular seat the preshaped seat-covering sheet of which the exposed surface is adhered to the top surface of the annular seat tears along the tear lines to separate the flaps from the pre-shaped seat-covering sheet to release the pre-shaped seat-covering sheet from the stack and leave the pre-shaped seat-covering sheet on the top surface of the annular seat; and the cover comprises a plurality of flapper means situated in respective first positions to hold the stack of pre-shaped seat-covering sheets in the shallow recess of the bottom face of the pivotal cover and pressure sensitive means (a) for moving, as the pivotal cover is applied to the annular seat, the flapper means from their first positions to respective second positions so as to release the pre-shaped seat-covering sheet of which the exposed surface is adhered to the top surface of the annular seat, and (b) for returning, as the pivotal cover is moved away from the annular seat, the flapper means from their second positions back to their first positions to retain in the shallow recess the pre-shaped seat-covering sheets other than the pre-shaped seat-covering sheet of which the exposed surface is adhered to the top surface of the annular seat.

The objects, advantages and other features of the present invention will become more apparent upon reading of the following non restrictive description of a preferred embodiment thereof, given by way of example only with reference to the accompanying drawings.

BRIEF DESCRIPTION OF THE DRAWINGS

In the appended drawings:

FIG. 2 is an elevational, partly cross sectional view of a piston device of the toilet of FIG. 1, for retarding return of the cup from a tilted position to a non-tilted position;

FIG. 6 is a cross sectional perspective view of the tilting cup of the toilet of FIG. 4;

DETAILED DESCRIPTION OF THE PREFERRED EMBODIMENTS

Figure 1:
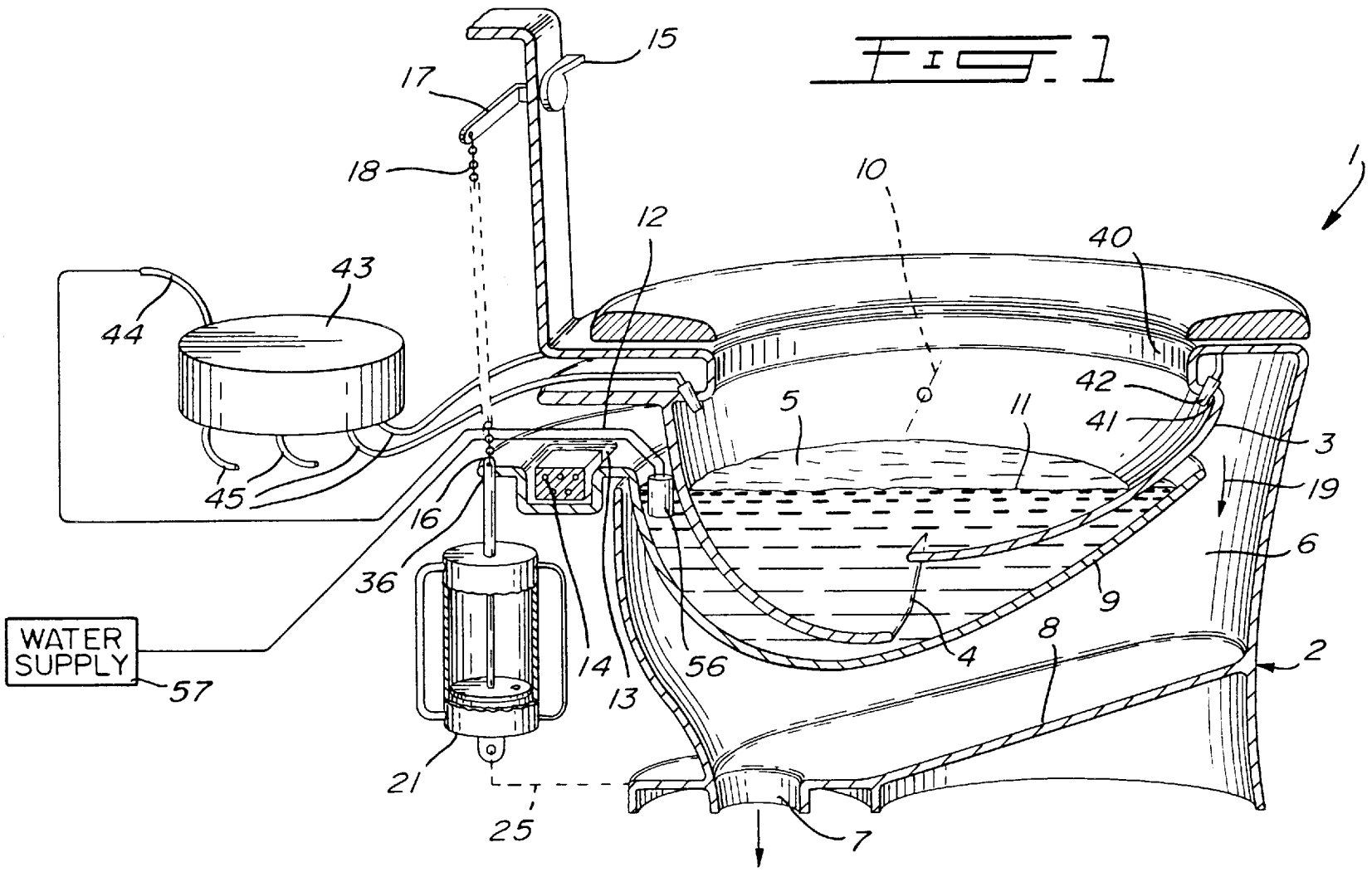
FIG. 1 is a perspective, cross sectional view of a first preferred embodiment of the toilet in accordance with the present invention, comprising a tilting cup.

A first preferred embodiment of the toilet in accordance with the present invention is illustrated in FIG. 1 and is generally identified by the reference 1.

The toilet 1 comprises a frame 2. The frame 2 is advantageously made of porcelain. However, other materials such as plastics and fibreglass can be contemplated.

The frame 2 includes a toilet bowl 3 formed with a waste water bottom discharge opening 4 oriented generally forwardly to discharge waste water 5 from the bowl 3 in a generally forward flow.

Under the toilet bowl 3, the frame 2 defines a hollow chamber 6. Hollow chamber 6 comprises a waste water bottom discharge hole 7 connectable to a conventional waste pipe (not shown). As shown in FIG. 1, the hollow chamber 6 defines a bottom wall 8 sloping toward the discharge hole 7 whereby waste water discharged in the hollow chamber 6 falls on that bottom wall 8 and flows toward the discharge hole 7 to be evacuated through the latter hole 7 and the waste pipe (not shown) connected thereto.

Interposed between the bowl 3 and the hollow chamber 6 is a tilting cup 9 made from any suitable material such as plastic, porcelain, fibreglass, resinous material, metal, etc. More specifically, the tilting cup 9 is pivotally mounted on the frame 2 about a horizontal, transversal axis 10. It is to be understood that tilting cup 9 could also be pivotally mounted on a support surface other than frame 2. In the non-tilted position of FIG. 1, the cup 9 follows the general outline of the toilet bowl 3 and therefore extends over the discharge opening 4 of the toilet bowl 3. As the cup 9 is not tilted, it is capable of containing water 5 which is communicated to the toilet bowl through the bottom discharge opening 4. Of course, the cup 9 is sufficiently large to retain a required level 11 of water 5 in the toilet bowl 3, level 11 being sufficient to prevent escape of sewage gases in the room in which the toilet is placed.

The tilting cup 9 comprises a rearwardly extending tongue 12 formed with a top cavity 13 in which a counterweight 14 is placed. The position of the axis 10 and the mass of the counterweight 14 are selected to enable the counterweight 14 to counterbalance the mass of water 5 and maintain the cup 9 in the non-tilted position of FIG. 1.

To operate the toilet 1, the user rotates a handle 15 to lift the rear free end 16 of the tongue 12 through a lever 17 and a chain 18. The cup 9 then is tilts in the direction of the arrow 19 until it reaches a tilted position such as that shown in FIG. 5. Then waste water 5 from the bowl 3 is then discharged through the opening 4, and then is discharged from the cup 9 to the hollow chamber 6 to be finally evacuated through the discharge hole 7 and the waste pipe (not shown) connected thereto (see arrow 20 of FIG. 5).

In the tilted position of the cup 9 (see for example FIG. 5) the counterweight 14 still produces a lever force tending to return the tilted cup 9 to its original non-tilted position of FIG. 1. However, return of the tilted cup 9 to its original non-tilted position of FIG. 1 is delayed by a given period of time by means of a piston device 21.

As illustrated in FIG. 2 of the appended drawings, the piston device 21 comprises a cylinder 22 having a lower end wall 23 pivotally connected to the frame 2 of the toilet 1 through a bracket 24 (see mechanical link shown as a dashed line 25 in FIG. 1). A piston 26 is mounted slidable into the cylinder 22, imperviousness of the joint between the peripheral edge surface of the piston 26 and the inner wall of the cylinder 22 being ensured by a dynamic O-ring 27. A piston rod 29 has one end secured centrally of the face of the piston 26 opposite to the lower end 23 of the cylinder 22 and a second end 36 pivotally connected to the rear free end 16 of the tongue 12 of the cup 9. The piston rod 29 passes through a hole 32 of the upper end wall 30 of the cylinder 22, imperviousness of the joint between the piston rod 29 and the hole 32 being ensured by a dynamic O-ring 31.

As can be seen in FIG. 2, the piston 26 divides the inner volume of the cylinder 22 into upper 33 and lower 34 chambers. A conduit 35 of larger diameter enables easy transfer of the air from chamber 33 to chamber 34 so as not to impede tilting movement of the cup 9 triggered by the action of the handle 15, lever 17 and chain 18. A check valve 37 is mounted in the conduit 35 to enable flow of air only from the upper chamber 33 to the lower chamber 34. A conduit 38 of smaller diameter, provided with an adjustable choker 39 also interconnects the upper 33 and lower 34 chambers of the cylinder 22.

As the tilted cup 9 is returned to its original non-tilted position of FIG. 1 by the lever force produced by the counterweight 14, air is transferred from the lower chamber 34 to the upper chamber 33 of the cylinder 22. This air transfer can be carried out only through the conduit 38 of smaller diameter. The resistance to air flow induced by the combined action of the small diameter of the conduit 38 and the choker 39 slows down the pivotal movement of the cup 9 to thereby retard pivotal movement, that is return of that cup 9 to the non-tilted position of FIG. 1 by a given period of time adjustable through adjustment of the choker 39. Of course, this period of time must be sufficiently long to enable the waste water 5 from the bowl 3 to be evacuated, and to enable cleaning of the bowl 3 and cup 9.

Obviously, the piston device 21 may be replaced by any other mechanism capable of fulfilling the same function. Similarly, it is also to be understood that the combination of handle 15, lever 17 and chain 18 may be easily replaced by other triggering systems such as electrical, electronic or pneumatic systems.

Referring back to FIG. 1, the toilet bowl 3 defines an upper hollow rim 40 defining a bottom annular flange 41 situated inside the bowl 3. Emerging from the flange 41 are peripherally distributed nozzles 42 directed toward the inner wall of the toilet bowl 3.

Figure 5:
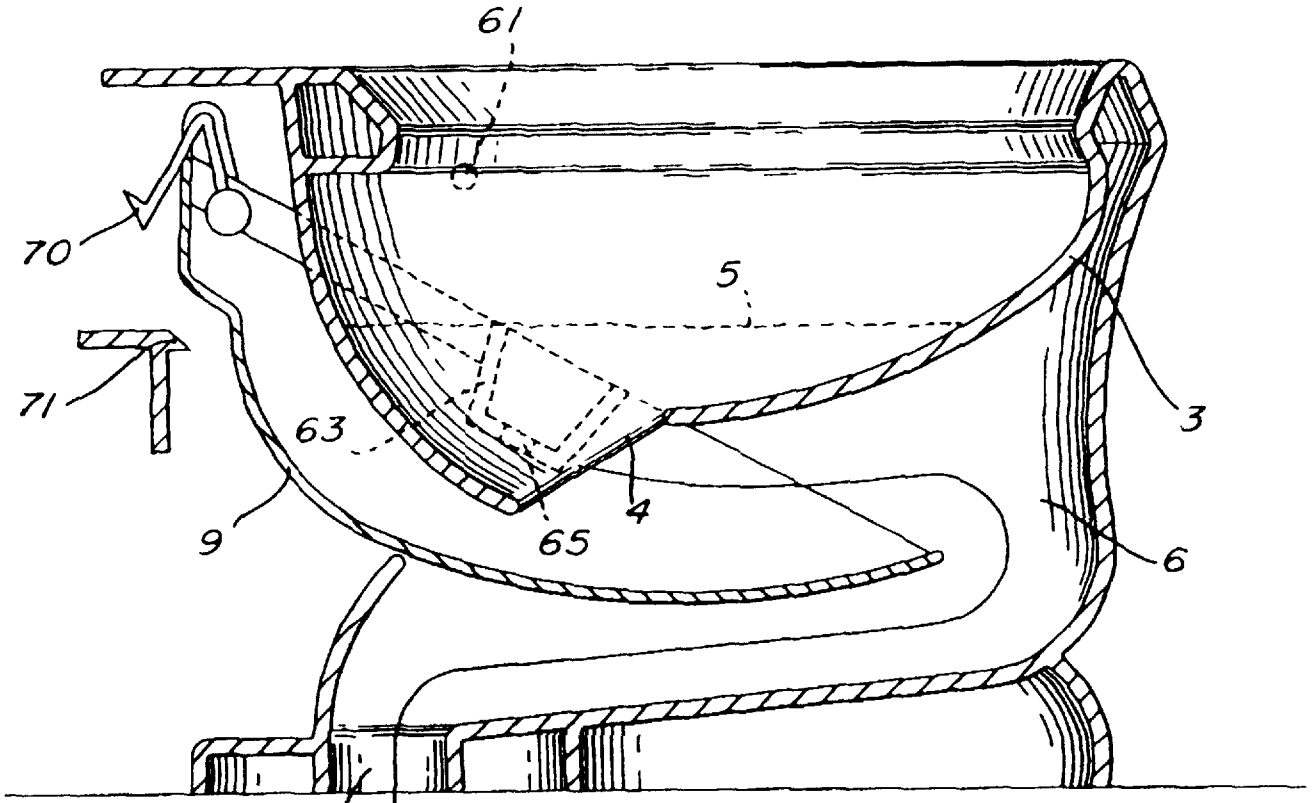
FIG. 5 is an elevational, partial cross sectional view of the toilet of FIG. 4, showing the tilting cup in a tilted position.

As the cup 9 is tilted from the position of FIG. 1 to a tilted position such as shown in FIG. 5, a sequential valve 43 (FIG. 1) is supplied with water through an inlet tube 44 to sequentially supply the nozzles 42 with this water through outlet tubes 45. An example of sequential valve is illustrated in FIG. 3.

Figure 3:
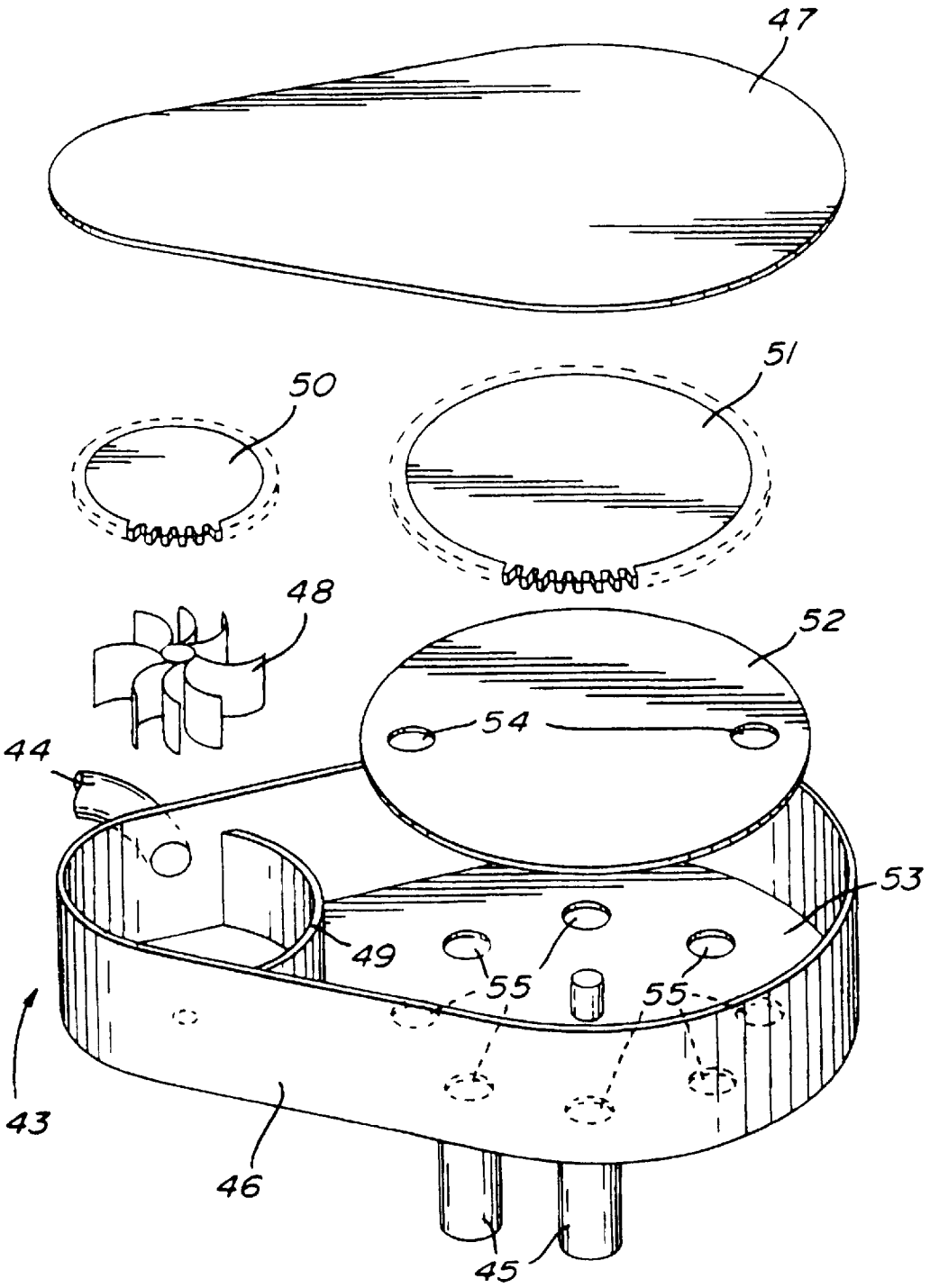
FIG. 3 is an exploded perspective view of a sequential valve of the toilet of FIG. 1.

The sequential valve 43 of FIG. 3 comprises a housing 46 and a cover 47 to close that housing 46 and form a water-tight enclosure. The water supplied to the sequential valve 43 through the inlet tube 44 drives a water turbine 48. An inner semicircular wall 49 of the housing 46 deviates the flow of water entering the housing 46 through the conduit 44 to efficiently drive the turbine 48. Rotational movement of the turbine 48 is transmitted to a toothed wheel 50 of smaller diameter in meshed engagement with a toothed wheel 51 of larger diameter. Rotational movement of the toothed wheel 51 is finally transferred to a water distribution disk 52.

The water distribution disk 52 is applied to the bottom face 53 of the housing 46. The water distribution disk 52 is provided with one or more pairs of diametrically opposite holes 54 while the bottom face 53 of the housing 46 is provided with several pairs of diametrically opposite holes 55 each connected to a corresponding one of the outlet tubes 45. Upon rotation of the disk 52, the pair of holes 54 become successively and sequentially aligned with each pair of diametrically opposite holes 55. The nozzles 42 are therefore supplied with water from the housing 46 by pairs and sequentially to produce sequential jets of water,whose function is to clean the inner wall of the toilet bowl 3 and the inside of the cup 9.

It is to be understood that the placement and number of holes 54 in distributing disk 52 and holes 55 in housing 46 can be varied at will to obtain any desired sequence and number of jets of water out of nozzles 42. Of course, the water distributing disk 52 can be replaced by any other types of valves capable of fulfilling the same function such as piano keys.

Those of ordinary skill in the art will appreciate that the orientation of the nozzles 42 is selected to optimize cleaning of the inner walls of the toilet bowl 3 and the inside of the cup 9. For the same purpose, the nozzles 42 can be designed to produce circular, oval and/or flat water jets. Also, the toilet can be provided with stationary, moving, translating, pivotal and/or rotating nozzles 42.

Of course, supply of water to the inlet tube 44 can be controlled both electronically and/or mechanically. As an example, a float valve 56 is mounted in the cup 9 outside the bowl 3 and is responsive to the level of water 5 falling below level 11 upon tilting of the cup 9 toward the position of FIG. 5, to supply water from a water supply 57 to the inlet tube 44 of the sequential valve 43. In the same manner, after the cup 9 has returned to the non-tilted position of FIG. 1, the float valve 56 detects reaching of the level 11 by the water 5 to interrupt supply of water from the water supply 57 to the inlet tube 44. of course, it is within the scope of the present invention to replace the float valve 56 by any electronic and/or mechanical devices capable of performing the same water supply control operation. Similarly, to compensate for excessive water level at standby, a small hole can be provided in cup 9 at an appropriate level to drain away excess water.

Operation of the toilet 1 of FIG. 1 therefore involves the following steps:

(a) the handle 15 is manually turned to cause tilting of the cup 9 from the position of FIG. 1 to a tilted position such as that of FIG. 5;

(b) waste water from the bowl 3 and the cup 9 is discharged in the hollow chamber 6 and then evacuated through the discharge hole 7 and the waste pipe (not shown);

(c) lowering of the level of water 5 below level 11 is detected by the float valve 56; the float valve 56 then supplies water from the water supply 57 to the sequential valve 43 through the inlet tube 44;

(d) the sequential valve 43 supplies water to the nozzles 42 in pairs and sequentially through the outlet tubes 45 in order to produce sequential jets of water to clean the inner wall of the toilet bowl 3 and the cup 9;

(e) the tilted cup 9 is returned to the non-tilted position of FIG. 1 by the lever force produced by the counterweight 14, this pivotal movement being slowed down by the action of the piston device 21;

(f) as the tilted cup 9 pivots about the axis 10 to return to the position of FIG. 1, the cup is gradually filled with water from the nozzles 42; and (g) when the cup 9 has returned to the position of FIG. 1 and the water from the nozzles 42 has filled the cup 9 to level 11, the float valve 56 is shut off and the sequential valve 43 is no longer supplied with water. The toilet 1 is then ready to be operated again through manual operation of the handle 15.

Figure 1A:
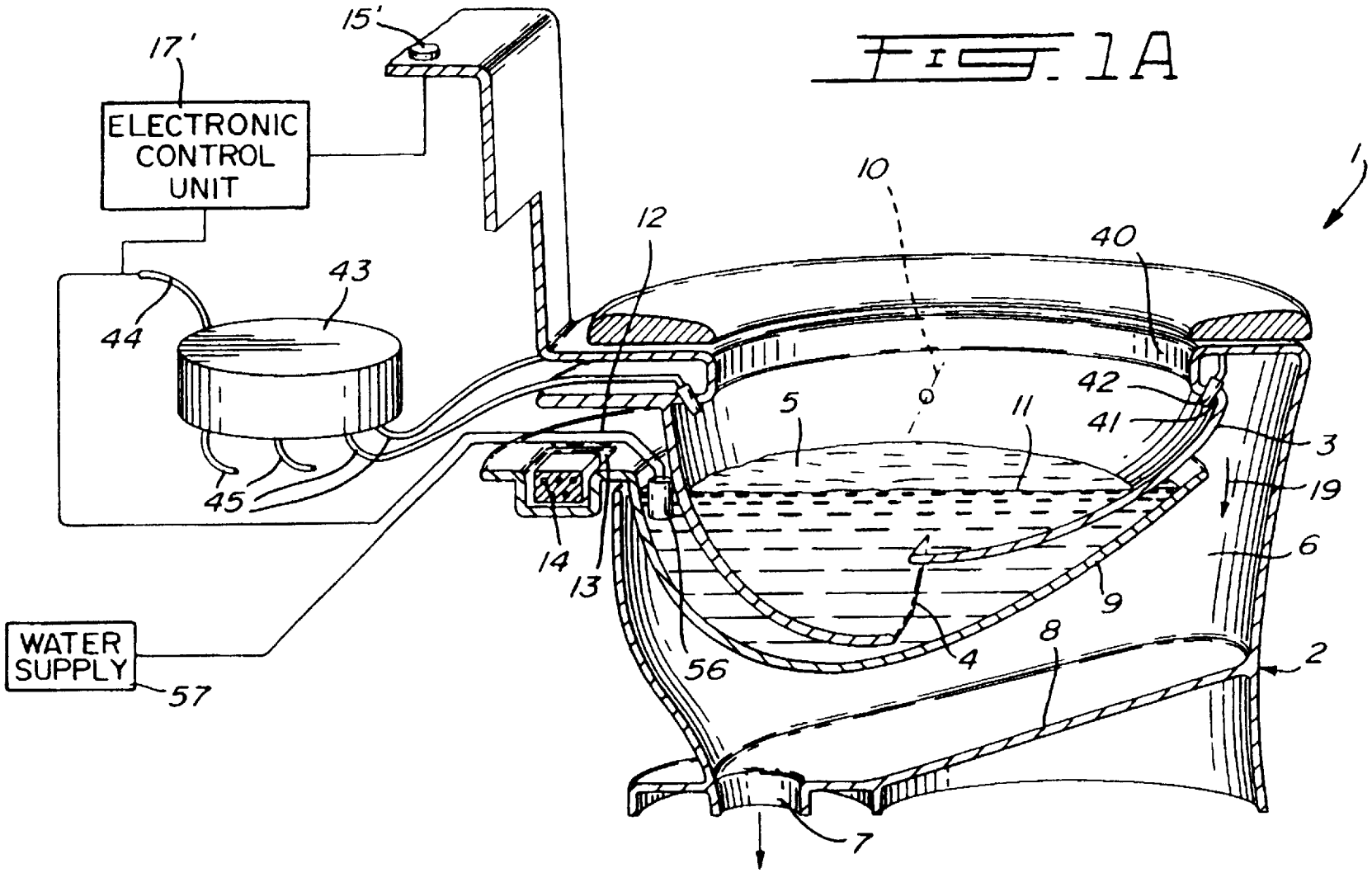
FIG. 1*a* is a perspective, cross sectional view of an optional embodiment of the toilet in accordance with the present invention.

Referring now to FIG. 1*a,* it is also within the scope of the present invention to replace the handle 15, lever 17 and chain 18 assembly with an electrical triggering system. In such a system, the stem 12 of cup 9 is appropriately weighted with counterweight 14 to bias the position cup 9 in a first non-tilted position. When the cup is sufficiently filled with water and waste products (about ¾ full), the cup 9 will automatically begin to tilt because of gravity as the weight of cup 9 and its content overcomes the weight of counterweight 14. Consequently, in such a system, handle 15, lever 17 and chain 18 are replaced by a single push button trigger 15' or optionally a remote control unit (not shown) which activates an electronic control unit 17' which in turn activates a valve to supply water from a water supply 57 to the inlet tube 44 of the sequential valve 43. Sequential jets of water are then ejected inside the inner wall of the toilet bowl 3 and inside the cup 9 to gradually fill cup 9 to a ¾ full level so that it automatically tilts as described above. When tilted, cup 9 will assume a second position namely the tilted position shown in FIG. 5. Throughout this tilting movement of cup 9, nozzles 42 will continue to eject water on the inner surface of bowl 3 and cup 9 to. Delay means such as the above described piston device 21 can be provided to delay the return of cup 9 to its non-tilted position. With or without delay means, cup 9 will of course automatically resume its first non-tilted position because of counterweight 14. Electronic control unit 17' is of course programmed to effect sequential and timed spraying of nozzles 42 to effect a thorough rinsing of bowl 3 and cup 9.

In an optional embodiment, electronic control unit 17' can be programmed to repeat the above described cycle, namely to once again fill cup 9 to about ¾ full this time with fresh rinse water to thoroughly clean bowl 3 and cup 9 which will once again tilt into the second position shown in FIG. 5, return to its original non-tilted position shown in FIG. 1*a* and be finally filled with water to a preset level, as described in relation with FIG. 1, to prevent escape of sewage gases from drain hole 7. This final step will place the toilet 1 in its standby position.

A second preferred embodiment of the toilet in accordance with the present invention, generally identified by the reference 60, will now be described with reference to FIGS. 4–8 of the appended drawings.

It should be pointed out that the corresponding elements of the first and second preferred embodiments of the toilet according to the invention are identified by the same reference numerals.

Figure 4:
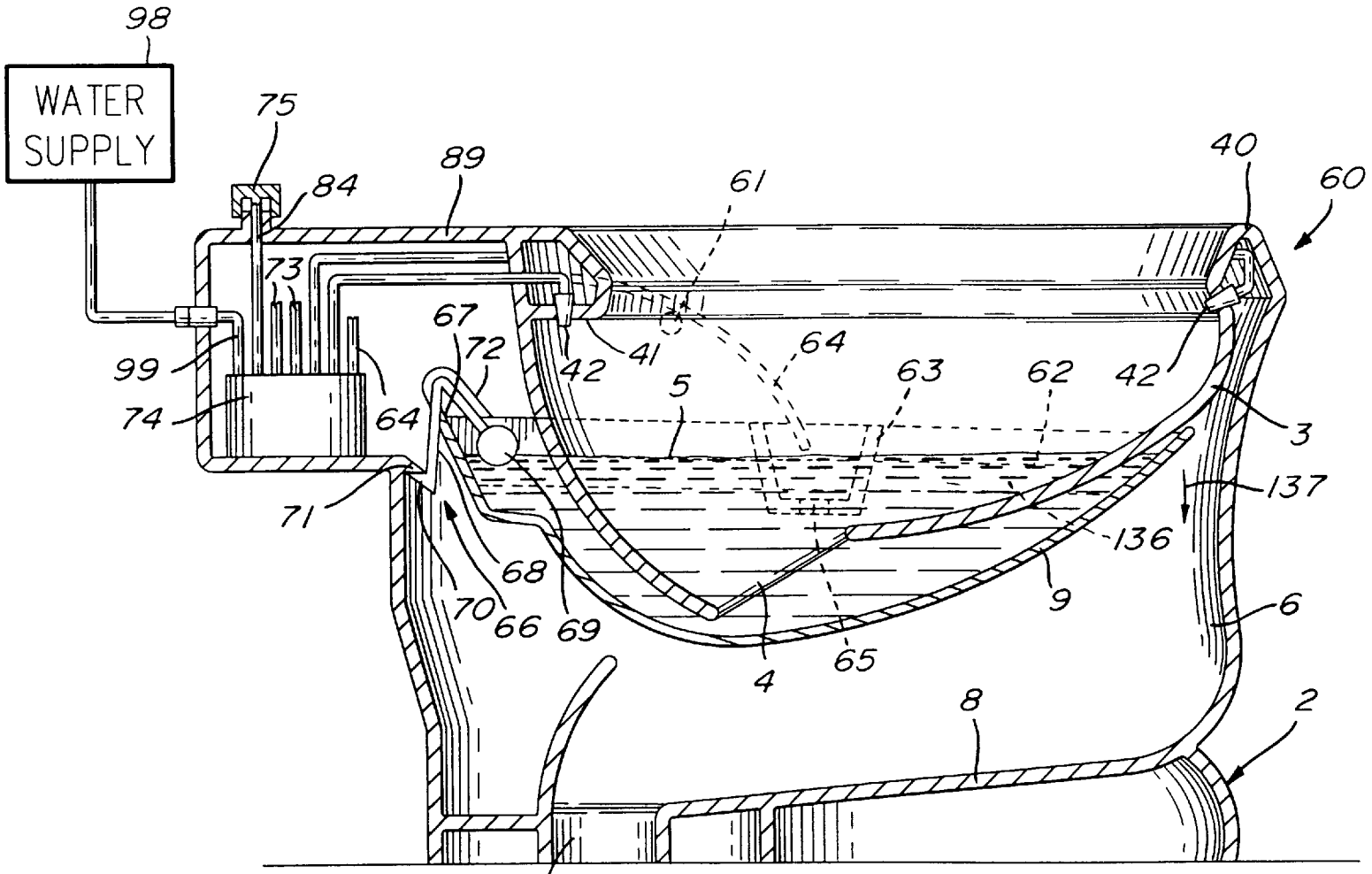
FIG. 4 is an elevational, cross sectional view of a second preferred embodiment of the toilet in accordance with the present invention, comprising a tilting cup shown in a non-tilted position and a control valve device for controlling supply of water to the toilet.

Referring to FIG. 4, the toilet 60 comprises a frame 2. The frame 2 is advantageously made of porcelain. However, other materials such as plastics and fibreglass can be contemplated.

The frame 2 includes a toilet bowl 3 formed with a waste water bottom discharge opening 4 oriented generally forwardly to discharge waste water 5 from the bowl 3 in a generally forward flow.

Under the toilet bowl 3, the frame 2 defines a hollow chamber 6. Hollow chamber 6 comprises a waste water bottom discharge hole 7 connectable to a conventional waste pipe (not shown). As shown in FIG. 4, the hollow chamber 6 defines a bottom wall 8 sloping toward the discharge hole 7 whereby waste water discharged in the hollow chamber 6 falls on that bottom wall 8 and flows toward the discharge hole 7 to be evacuated through the latter hole 7 and the waste pipe (not shown) connected thereto.

Interposed between the bowl 3 and the hollow chamber 6 is a tilting cup 9. More specifically, the tilting cup 9 is pivotally mounted on the frame 2 about a horizontal, transversal axis 61. In the non-tilted position of FIG. 4, the cup 9 follows the general outline of the toilet bowl 3 and therefore extends over the discharge opening 4 of the toilet bowl 3. As the cup 9 is not tilted, it is capable of containing water 5 which is communicated to the toilet bowl 3 through the bottom discharge opening 4. Of course, the cup 9 is sufficiently large to retain a level 62 of water 5 in the toilet bowl 3.

Referring to FIGS. 4 and 6, the tilting cup 9 is formed with pair of symmetrical, lateral and integral water reservoirs of which only the left one 63 is illustrated. Reservoir 63 is supplied with water through a tube 64 shown in dashed line in FIG. 4. Reservoir 63 also comprises a bottom orifice 65.

The preferred embodiment of FIG. 4 uses a spring-biased float-operated latch mechanism 66. In this preferred embodiment, the tilting cup 9 comprises no rearwardly extending tongue but a rear edge 67. Mechanism 66 comprises a V-shaped arm 68 pivotally mounted on the rear edge 67 of the tilting cup 9. On the end of the V-shaped arm 68 situated inside the cup 9 is mounted a float 69. A latch 70 is formed on the other end of the V-shaped arm 68 situated outside the cup 9. Latch 70 engages a latch-engaging hook element 71 formed integral with the frame 2 of the toilet 60 to maintain the cup 9 in the position of FIG. 4. A spring element 72 normally applies the latch 70 to the hook element 71.

As illustrated in FIG. 4, the toilet bowl 3 defines an upper hollow rim 40 defining a bottom annular flange 41 situated inside the bowl 3. Emerging from the flange 41 are the peripherally distributed nozzles 42 directed toward the inner wall of the toilet bowl 3 and supplied with water through respective outlet tubes 73 of a control valve device 74.

An it will be explained in the following description, operation of the toilet 60 is controlled by a valve device 74.

To operate the toilet 60, the user has only to depress a push-button 75 (FIG. 4).

Figure 7:
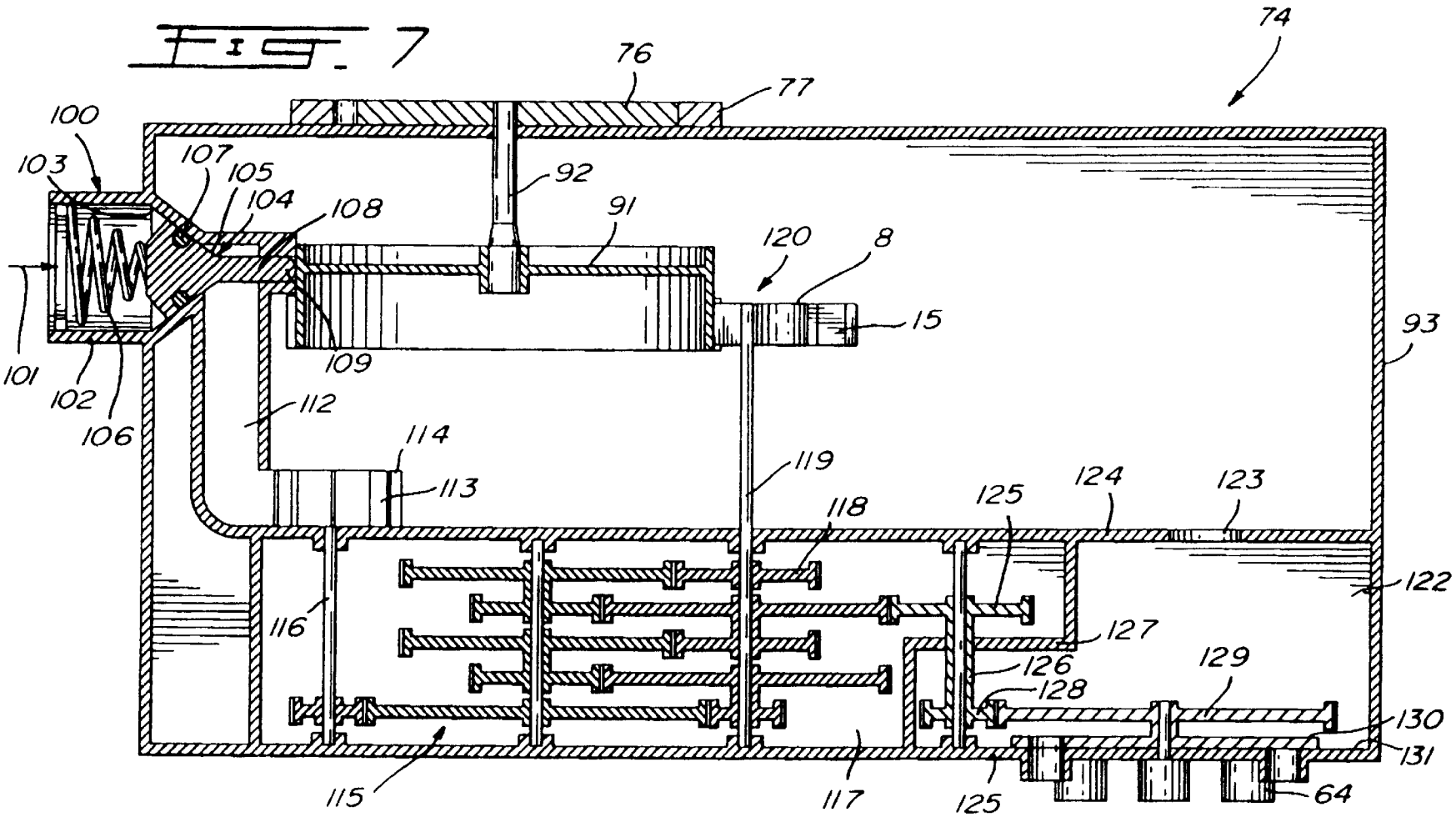
FIG. 7 is an elevational, cross sectional view of the control valve device of the toilet of FIG. 4.
Figure 8:
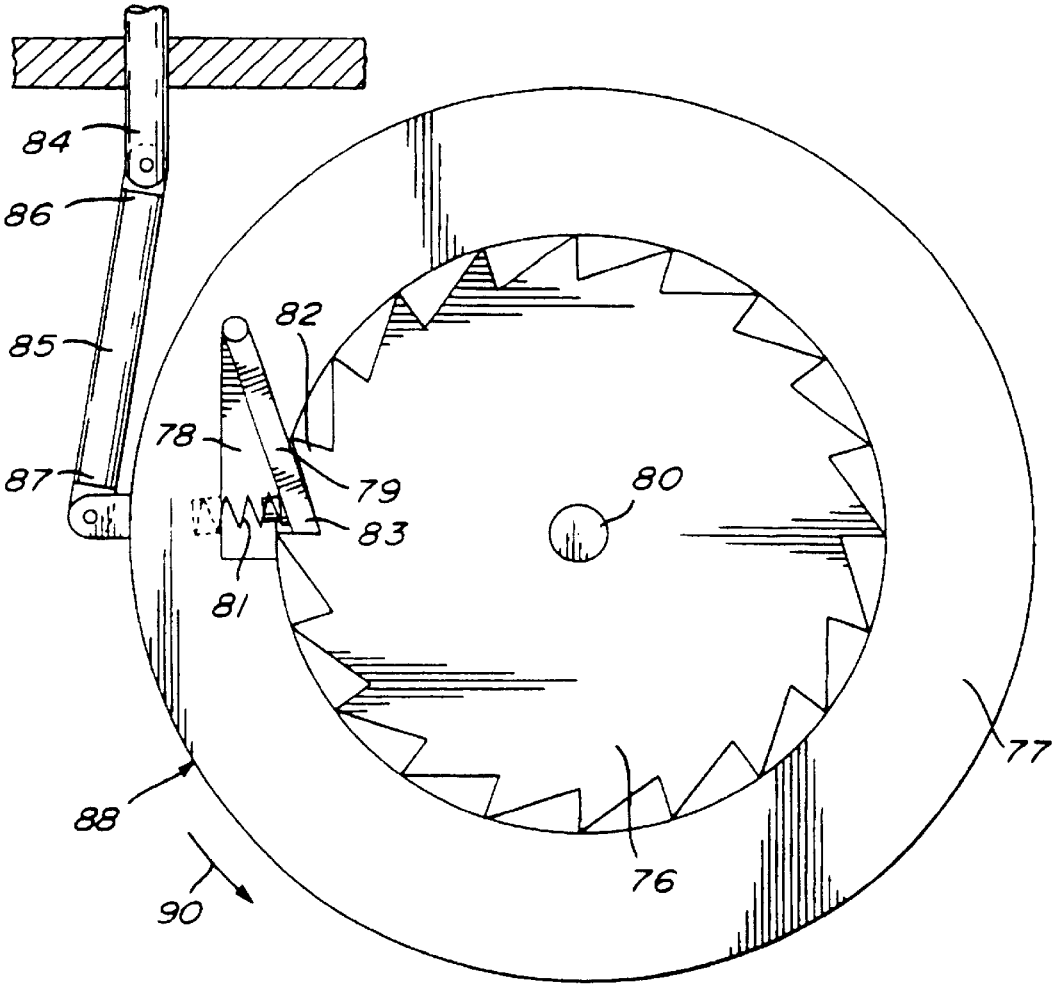
FIG. 8 is a top plan view of a push-button mechanism for triggering operation of the control valve device of FIG. 7, this mechanism comprising a connecting rod activated by depression of the push-button to rotate a peripheral ring, a sawtoothed wheel 76 and a pawl for transmitting rotational movement of the ring to the sawtoothed wheel.

Referring now to FIGS. 7 and 8, the control valve device 74 comprises a sawtoothed wheel 76 surrounded by a ring 77 generally rectangular in cross section. Pivotally mounted in an inner cavity 78 of the ring 77 is a spring-biased pawl 79. More specifically, the pawl 79 has a proximate end pivotally mounted about an axis generally parallel to the axis 80 of rotation of the sawtoothed wheel 76. A spring 81 interposed between the bottom of the cavity 78 and the pivotal pawl 79 urges the free distal end 83 of this pawl 79 on the sawtooth such as 82 of the wheel 76.

The push-button 75 comprises a rod 84 passing through a top wall 89 of the frame 2 and extending toward the control valve device 74. A connecting rod 85 (FIG. 8) has a first end 86 pivotally connected to the end of the rod 84 opposite the push-button 75, and a second end 87 pivotally connected to the outer peripheral edge face 88 of the ring 77.

Upon depression of the push-button 75, longitudinal movement of the rod 84 is transmitted through the connecting rod 85 to rotate the ring 77 about the axis 80 in direction 90. Rotational movement of the ring 77 is then transmitted to the sawtoothed wheel 76 through the pawl 79 of which the end 83 is engaging one sawtooth 82. Upon releasing the push-button 75, this push-button returns to its non-depressed position (by the action of, for example, a spring (not shown)). The ring 77 then rotates in the direction opposite to direction 90 and the spring-biased pawl 79 slides on the sawtooth 82 to engage another upstream tooth 82.

Figure 9B:
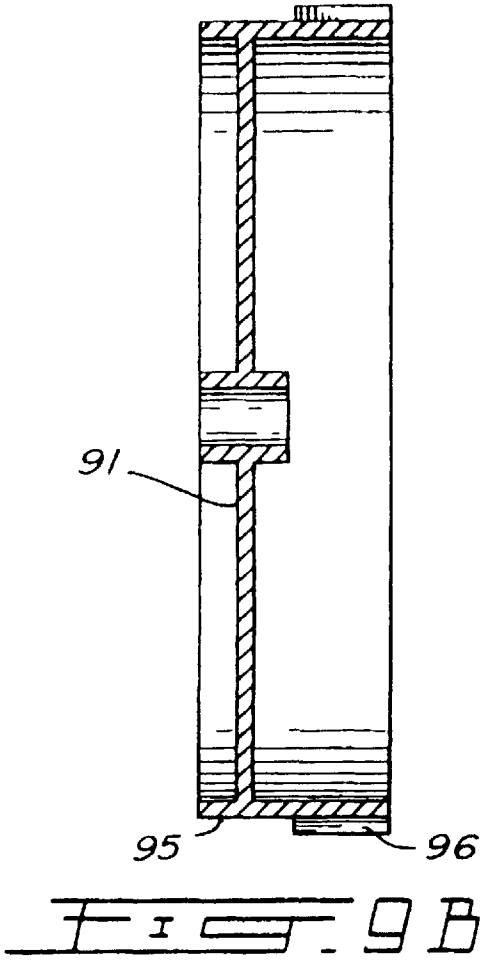
FIG. 9*b* is a cross sectional, side elevational view of the partially toothed cam wheel of FIG. 9*a;*
Figure 9A:
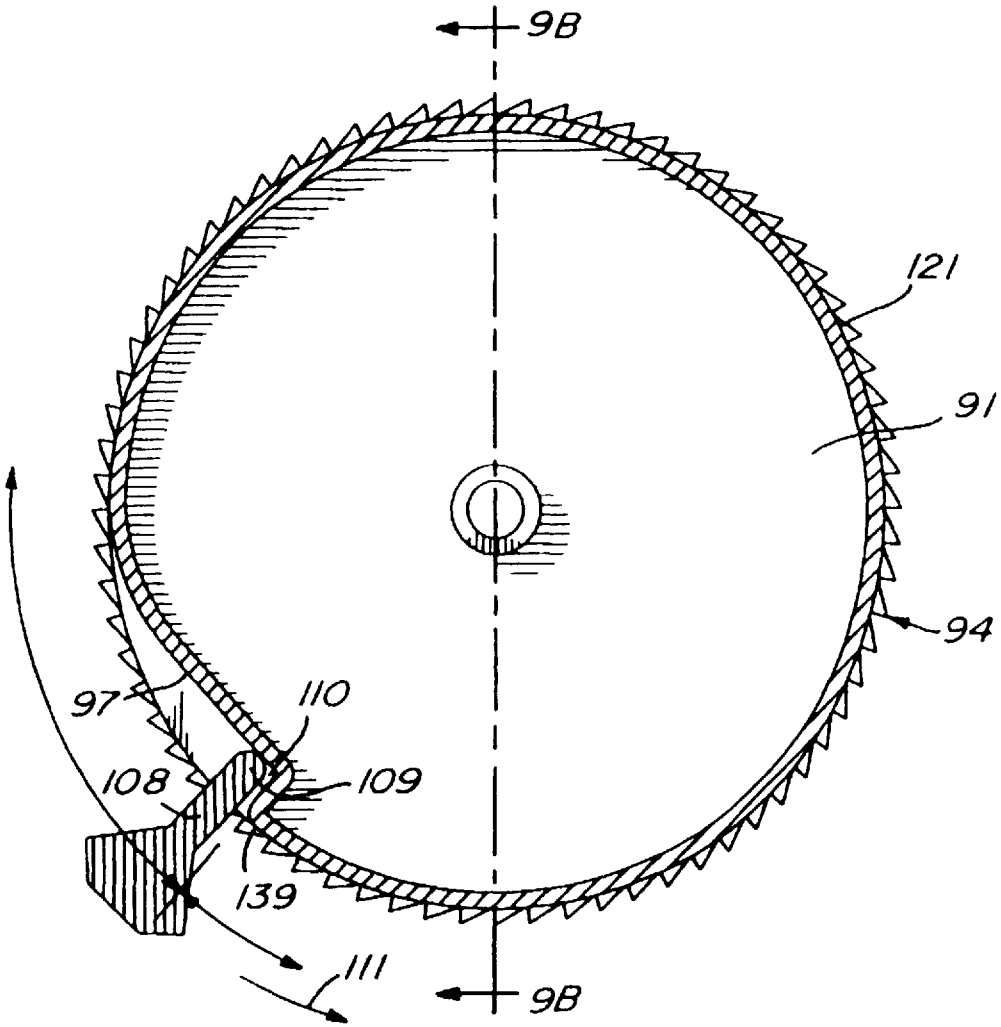
FIG. 9*a* is a top plan view of a partially toothed cam wheel of the control valve device of FIG. 7.

Rotational movement of the sawtoothed wheel 76 caused by depression of the push-button 75, is transmitted to another toothed wheel 91 through a shaft 92. As illustrated in FIGS. 9*a* and 9*b*, wheel 91 comprises a peripheral, annular edge surface 94 divided into a smooth annular axial portion 95 and a toothed annular axial portion 96. The smooth annular axial portion 95 defines a cam section 97 and a semicircular section 121 (FIG. 9*a*).

As shown in FIG. 8, wheel 76 and ring 77 may be located outside a water-tight housing 93 of the control valve device 74, while wheel 91 is situated inside that housing 93.

Water is supplied to the control valve device 74 from a water supply 98 through an inlet tube 99 (FIG. 4), and then through a spring-biased valve 100 (see arrow 101 in FIG. 7). Valve 100 comprises a tubular member 102 defining a conical seat 103, and a plug element 104 defining a conical surface 105 fitting into the conical seat 103 and applied to that seat 103 by means of a spring 106. An O-ring 107 ensures imperviousness of the joint between the seat 103 and the conical surface 105. The plug element 104 comprises an integral slender extension 108 extending inside the housing 93 and having a rounded free end 109 applied to and sliding on the smooth annular axial portion 95 of the wheel 91.

Initially, the rounded free end 109 of the extension 108 is in the position shown in FIG. 9*a*, that is in the corner 110 of the cam section 97. Rotational movement of the wheel 91 in direction 111 (FIG. 9*a*) imparted by depression of the push-button 75 causes sliding or the free end 109 on the cam section 97 and axial movement of the extension 108 against the force produced by the spring 106. The conical surface 105 then moves apart from the conical seat 103 whereby water penetrates through the valve 100 and flows through a conduit 112 formed inside the housing 93 to drive a turbine 113. The conduit 112 comprises a semicircular wall 114 to deviate the flow of water so as to efficiently drive the turbine 113.

Rotational movement of the turbine 113 is transmitted to a speed-reducing gear system 115 through a shaft 116. The gear system 115 is situated in a water-tight compartment 117 of the housing 93 whereby no water reach the toothed wheels of that gear system 115.

The speed-reducing gear system 115 comprises a toothed wheel 118 to which rotation is imparted upon rotation of the turbine 113. The toothed wheel 118 is mounted onto a shaft 119 rotating therewith to drive a wheel rotating ratchet mechanism 120 engaging the teeth of the toothed annular axial portion 96 of the wheel 91 to rotate this wheel 91 at a given speed in direction 111. This type of ratchet mechanism is well known to those of ordinary skill in the art and accordingly will not be further described herein.

Therefore, as the toothed wheel 118 rotates to drive the ratchet mechanism 120 and rotate wheel 91 in direction 111, the rounded free end 109 of the plug element 104 slides first on the cam section 97 of the smooth annular axial portion 95 of the annular edge surface 94 of the wheel 91 to gradually open the valve 100, and then on the semicircular section 121 in which the valve 100 is fully open.

In the meantime, the water from the conduit 112 having driven the turbine 113 fills the housing 93 and is supplied to a compartment 122 of that housing 93 through a hole 123 of a partition wall 124 (see FIG. 7).

Also, the speed-reducing gear system 115 comprises a toothed wheel 125 to which rotation is imparted upon rotation of the turbine 113. The toothed wheel 125 is mounted on a tubular shaft 126 rotating therewith and passing through a partition wall 127 situated between compartments 117 and 122. Rotational movement of the toothed wheel 125 is transmitted, through the shaft 126, to a toothed wheel 128 of smaller diameter in meshed engagement with a toothed wheel 129 of larger diameter, wheels 128 and 129 being both mounted in the compartment 122. Rotational movement of the toothed wheel 129 is finally transferred to a water distribution disk 130.

Figure 10:
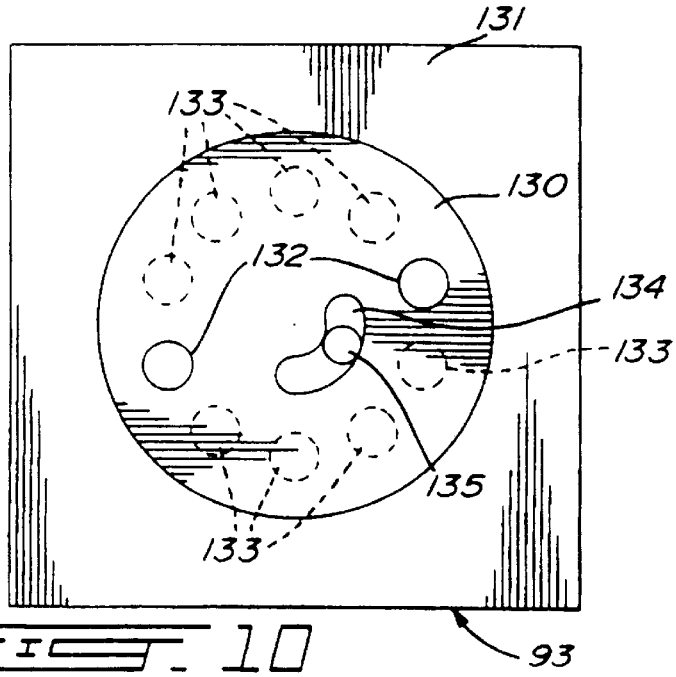
FIG. 10 is a top plan view of a water distribution disk of the control valve device of FIG. 7.

Referring to FIGS. 7 and 10, the water distribution disk 130 is applied to a wall surface 131 of the compartment 122. The water distribution disk 130 is provided with a pair of diametrically opposite holes 132 while the wall surface 131 of the compartment 122 is provided with several pairs of diametrically opposite holes 133 each connected to a corresponding one of the outlet tubes 73 of the control valve device 74. Upon rotation of the disk 130, the pair of holes 132 become successively and sequentially aligned with each pair of diametrically opposite holes 133. The nozzles 42 are therefore supplied with water from the housing 93 by pairs and sequentially to produce sequential jets of water whose function is to clean the inner wall of the toilet bowl 3 and the inside of the cup 9.

The water-distributing disk 130 is further provided with a semicircular oblong hole 134 associated with a hole 135 of the wall surface 131. Hole 135 is connected to tube 64 (FIG. 4) supplying the water reservoir 63 on both side of the cup 9.

Therefore, rotational movement of the wheel 91 in direction 111 (FIG. 9*a*) imparted by depression of the push-button 75 causes sliding or the free end 109 on the cam section 97 and axial movement of the extension 108 against the force produced by the spring 106 to allow water to flow through the conduit 112 and drive the turbine 113. Rotational movement of the turbine 113 is transmitted to the speed-reducing gear system 115 to rotate the toothed wheel 125, rotational movement of wheel 125 being transmitted to the water distribution disk 130 to supply the nozzles 42 with water from the housing 93 by pairs and sequentially to produce the sequential jets of water that clean the bowl 3 and cup 9.

Water from the nozzles 42 raises the level of water 5 in the toilet bowl 3 from an initial level 136 to level 62, level 136 being sufficient to prevent escape of sewage gases in the room in which the toilet is placed. In the meantime, when the oblong hole 134 of the water distributing disk 130 is aligned with the hole 135 of the wall surface 131, water is supplied to the two lateral reservoirs such as 63 through associated tube(s) such as 64. Tube(s) 64 pass close to the axis 61 and are flexible to prevent those tube(s) to impede tilting movement of the cup 9.

When water 5 has reached level 62, the lateral reservoirs such as 63 are full of water. Also, the float 69 is responsive to that level of water to pivot the V-shaped arm 68 and thereby disengage the latch 70 from the hook element 71. The cup 9 then tilts in the direction of the arrow 137 (FIG.

4) until it reaches the tilted position of FIG. 5. Then waste water 5 from the bowl 3 is discharged through the opening 4, and then is discharged from the cup 9 to the hollow chamber 6 to be finally evacuated through the discharge hole 7 and the waste pipe (not shown) connected thereto (see arrow 20 of FIG. 5).

In the meantime, the nozzles 42 continues to be supplied with water to produce the sequential jets of water, and water from the two reservoirs such as 63 is gradually discharged through the corresponding bottom orifice 65. As water discharges from the reservoirs such as 63 through the bottom orifices 65, the centre of gravity of the cup 9 and its contents translates rearwardly whereby the cup 9 pivots slowly about the axis 61 toward the original non-tilted position of FIG. 4, until the spring-biased latch 70 engages the hook element 71. This action delays return of the cup 9 to the non-tilted position by a predetermined period of time to enable appropriate evacuation of the waste water and cleaning of the bowl 3 and cup 9. The cup 9 may be structured for obtaining this translation of the centre of gravity. Alternatively, counterweights can be added as required to obtain this operation.

During return of the cup 9 to the non-tilted position of FIG. 4 and after the cup 9 has returned to the non-tilted position of FIG. 4, the jets of water from the nozzles 42 raise the level of water in the cup 9 and toilet bowl 3. The speed of rotation of the wheel 91 driven by the speed-reduced toothed wheel 118, the shaft 119 and the ratchet mechanism is adjusted in function of the pressure of water from the supply 98 to fill the bowl 3 and cup 9 to level 136 of FIG. 4. More specifically, when the level of water 5 reaches level 136, the rounded free end 109 of the extension 108 of the plug element 104 leaves the end 139 (FIG. 9*a*) of the semicircular section 121 of the smooth annular axial portion 95 of the annular edge surface 94 of the toothed wheel 91 to fall in corner 110. Then the O-ring 107 seals the joint between the conical seat 103 and the conical surface 105 whereby water is no longer supplied to the housing 93 through the valve 100 to thereby stop operation of the turbine 113 and therefore operation of the toilet 60 until the push-button 75 is depressed again to trigger the above described cycle of operation of the toilet 60.

Figure 11:
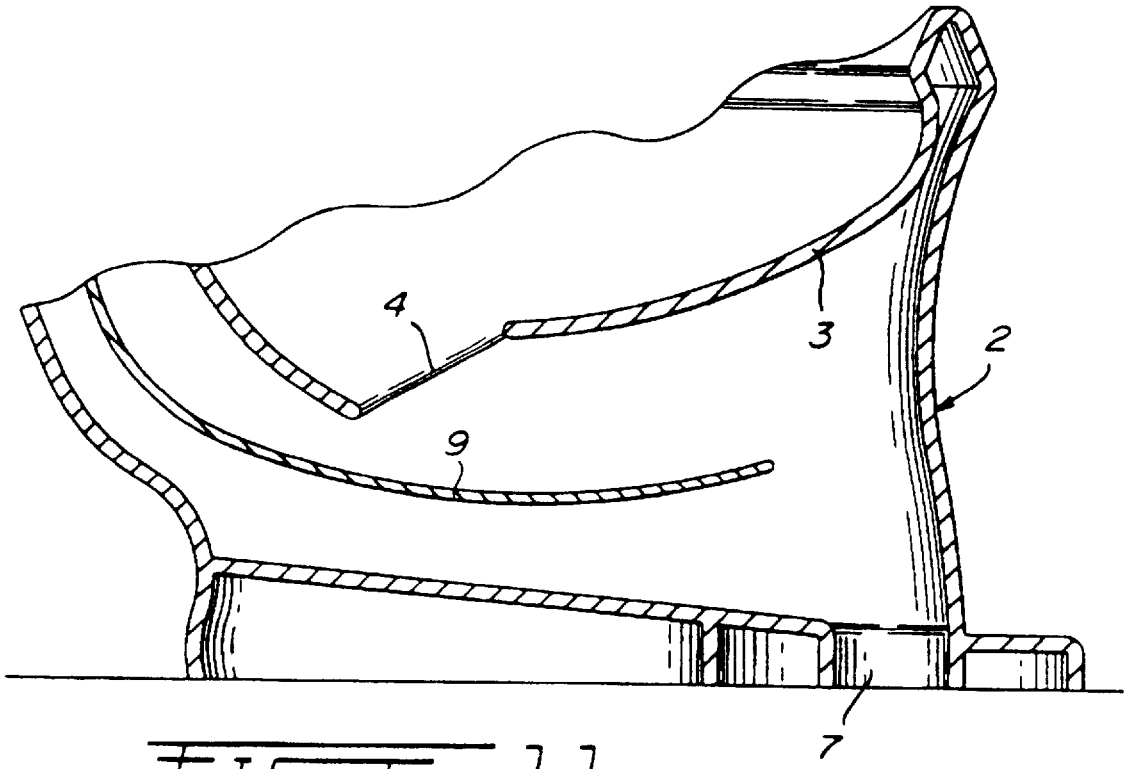
FIG. 11 is a partial side elevational view of the toilet of FIGS. 4 and 5, having a waste water bottom discharge hole situated at the front of the toilet frame.

FIG. 11 illustrates the waste water bottom discharge hole 7 situated in front of the hollow chamber 6 to facilitate evacuation of the waste water from the bowl 3 and cup 9. A drawback of the embodiment of FIG. 11 is that it does not meet with the construction standards presently in force. However, it would be easy, in new buildings, to displace the waste pipe (not shown) to receive the front waste water bottom discharge hole 7 of FIG. 11.

Figure 12:
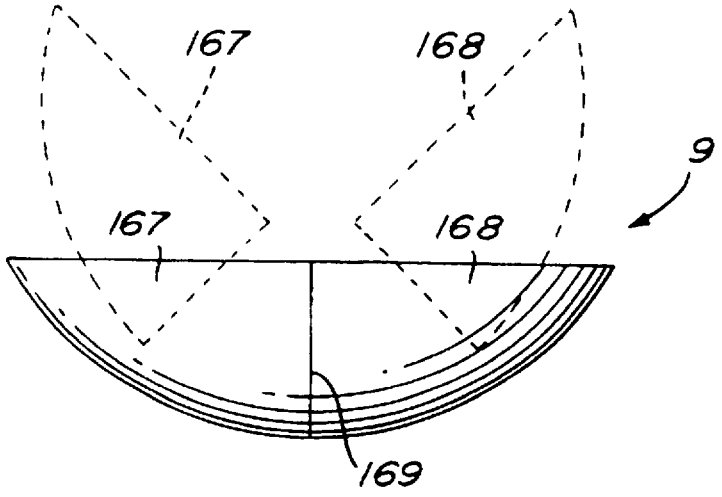
FIG. 12 is a side elevational view of an alternative tilting cup for use in the toilet in accordance with the present invention.

In FIG. 12, an alternative construction for the cup 9 is illustrated. It comprises two cup halves 167 and 168 both tilting as shown in dashed line to discharge waste water. A drawback of this alternative is that a water-tight seal 169 is required between the two halves 167 and 168 to hold water in the cup 9.

Figure 13:
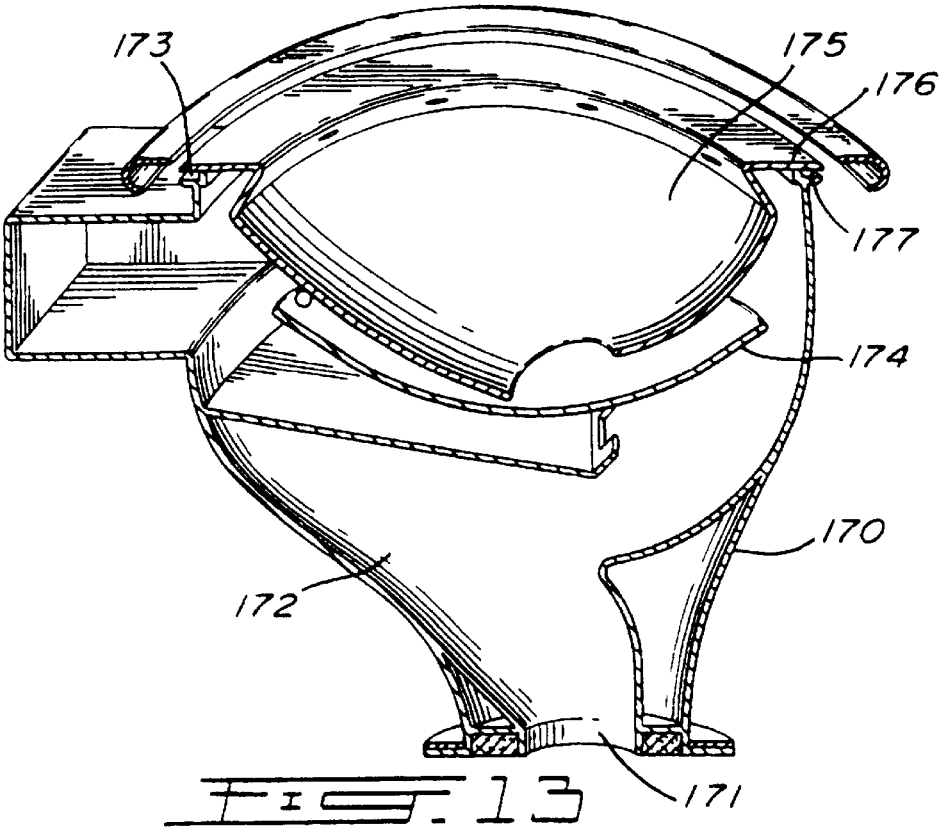
FIG. 13 is a cross sectional perspective view of a toilet in accordance with the present invention, made of three pieces.

To facilitate manufacture and maintenance of the non-flushing toilet in accordance with the present invention, it can be made of three pieces as illustrated in FIG. 13:

- a frame 170 defining a hollow chamber 172 with a waste water discharge hole 171 connectable to the waste pipe (not shown). and an upper rim 173;
- a toilet bowl 175 formed with a peripheral flange 176 to be mounted on the upper rim 173 with a rubber gasket 177 in between the rim 173 and the flange 176; and
- a tilting cup 174 pivotally mounted on the frame 179 or bowl 175.

Another aspect of the subject invention is concerned with a toilet provided with automatic distribution of seat-covering paper.

Figure 14:
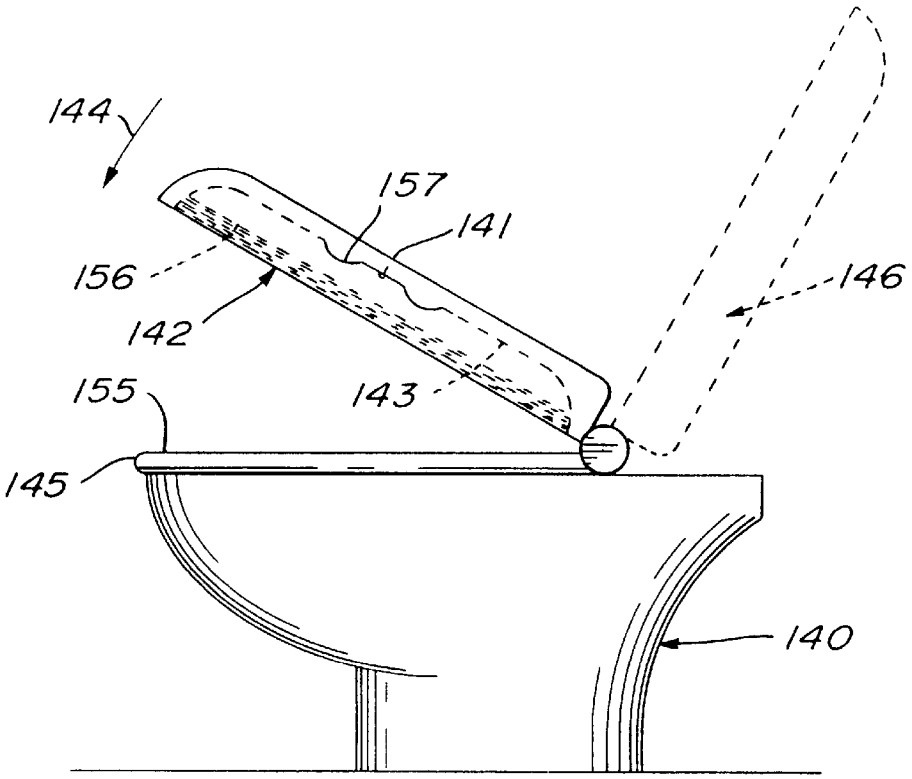
FIG. 14 is a side elevational view of a toilet comprising a seat and a cover in accordance with the present invention for distributing pre-shaped seat-covering paper sheets.

For that purpose a toilet 140 comprises, as illustrated in FIG. 14, a pivotal cover 141 having a bottom face 142 formed with a shallow annular recess 143 therein to contain pre-shaped seat-covering paper sheets. As it will be described in the following description, the user has only, to place of sheet of paper on the annular seat 145 of the toilet 140, to pivot the cover 141 in direction 144 to apply the cover 141 to the seat 145 and the to return the pivotal cover 141 to its normal rest position shown in dashed line at 146.

Figure 15:
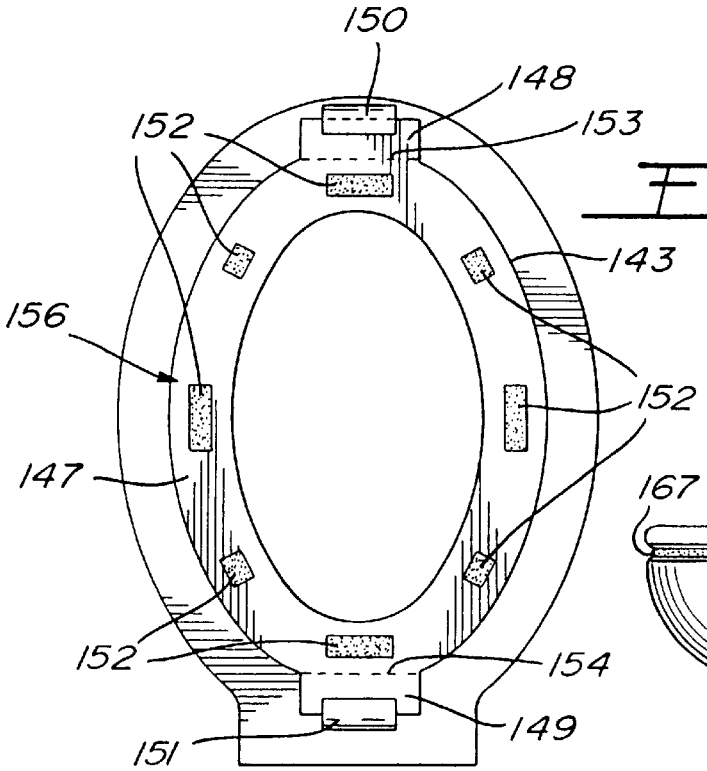
FIG. 15 is a bottom plan view showing a first embodiment of the toilet seat of FIG. 14.

According to a first preferred embodiment as illustrated in FIG. 15, a stack 156 of pre-shaped seat-covering paper sheets such as 147 are mounted in the shallow recess 143. Each paper sheet 147 has two diametrically opposite flaps 148 and 149 retained in the recess 143 by means of suitable pressure-applying fastener members 150 and 151. The exposed face of each paper sheet 147 is also provided with a plurality of adhesive strips 152 of which the positions are optimized in view of optimizing adhesion of such sheet to the top surface 155 of the seat 145. The flap 148 can be easily separated from the paper sheet 147 by tearing along a perforated line (tear line) 153. In the same manner, the flap 149 can be easily separated from the paper sheet 147 by tearing along a perforated line 154.

In operation, the pre-shaped paper sheet 147 already covering the top surface 155 of the toilet seat 145 is first removed. To install a fresh pre-shaped seat-covering paper sheet 147 from the stack 156, the user pivots the cover 141 in direction 144 to apply the exposed surface of the paper sheet 147 to the top surface 155 of the seat 145 so as to adhere the strips 152 to this top surface 155. Then, the pivotal cover 141 is pivoted in the direction opposite to arrow 144 in view of returning the cover 141 to its normal rest position 146. When the cover 141 leaves the seat 145, the strips 152 are adhered to the top surface 155 of the seat 145 and produce a retention force that causes tearing of the paper sheet 147 along the perforated lines 153 and 154 to thereby leave the paper sheet 147 on the seat 145, which paper sheet 147 is pre-shaped to fit on the convex top surface 155 of that seat 145.

Of course, the surface of each paper sheet 147 applied to the adhesive strips 152 of the adjacent next paper sheet 147 of the stack 156 is smooth and treated to prevent as much as possible adhesion of the strips 152 thereto.

Also, to better apply the exposed face of a paper sheet 147 to the top surface 155 of the seat 145, flat spring members such as 157 can be interposed between the bottom of the shallow recess 143 and the stack 156 of paper sheets 147.

Figure 16:
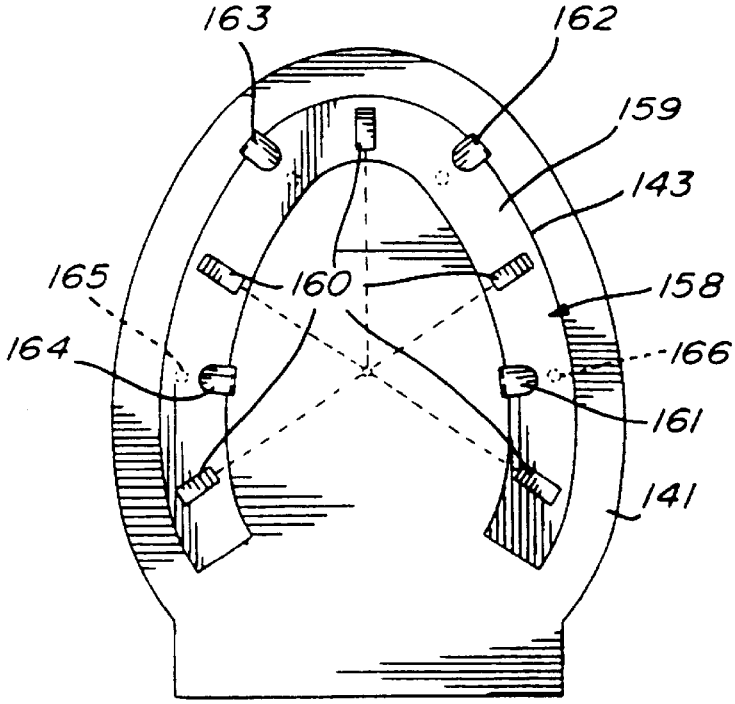
FIG. 16 is a bottom plan view showing a second embodiment of the toilet seat of FIG. 14.

According to a second preferred embodiment as illustrated in FIG. 16, the shallow recess 143 is horseshoe-shaped and a stack 158 of pre-shaped seat-covering paper sheets such as 159 are mounted in the shallow recess 143. The exposed face of each paper sheet 159 is provided with a plurality of adhesive strips 160 of which the positions are optimized in view of optimizing adhesion of such sheet to the top surface 155 of the seat 145. In the preferred embodiment of FIG. 16, the stack 158 of paper sheets 159 is held in the shallow recess 143 by means of mechanically and/or electrically operated pivotal flappers 161–164 in response to detection of pressure by pressure sensitive sensors 165 and 166. The pivotal flappers 161–164 can also be manually operated.

In operation, the pre-shaped paper sheet 159 already covering the top surface 155 of the toilet seat 145 is first removed. To install a fresh pre-shaped seat-covering paper sheet 159 from the stack 158, the user pivots the cover 141 in direction 144 to apply the exposed surface of the paper sheet 159 to the top surface 155 of the seat 145 so as to adhere the strips 152 to this top surface 155. The sensors 165 and 166 then detect pressure to withdraw the flappers 161–164. Thereafter the pivotal cover 141 is pivoted in the direction opposite to arrow 144 in view of returning the cover 141 to its normal rest position 146. When the cover 141 leaves the seat 145, the strips 160 are adhered to the top surface 155 of the seat 145 and the sensors 165 and 166 detect no pressure to release the flappers 161–164 which are then inserted in between the paper sheet 159 adhered to the seat 145 and the next adjacent sheet 159 of the stack 158. It is believed to be within the capacity of one of ordinary skill in the art to design the pressure-activated and mechanically and/or electrically operated flappers 161–164 of which the function and operation has been explained in the foregoing description.

Of course, each paper sheet 159 is pre-shaped to fit on the convex top surface 155 of the seat 145, and the surface of each paper sheet 159 applied to the adhesive strips 160 of the adjacent next paper sheet 159 of the stack 158 is smooth and treated to prevent as much as possible adhesion of the strips 160 thereto.

Of course, paper can be replaced by any other suitable material in the fabrication of the sheets 147 and 159.

To improve the users' comfort, electric heating elements (not shown) can be provided in the cover 141 to warm the paper sheets 147 or 159.

Referring now to FIG. 14, another aspect of the subject invention is concerned with a toilet provided with automatic seat disinfecting system provided in the toilet seat cover 141 and/or toilet basin ring 166 located immediately below toilet seat 145. In this embodiment, cover 141 and seat 145 are similar to conventional design in their general shape and capability of swivelling to a horizontal position or a raised back position. The inside portion of cover 141 can be provided with various cleaning and/or disinfecting systems (not shown), for example, solid or liquid cleaning agents, supersonic waves generators, heat generators, infra-red or ultra-violet light generating means, laser, air-current, freezing agents, detergent appliers, wipers, layers of chemicals or vinyl coatings which quickly harden into removable sheets on seat 145, etc. Of course, the cleaning/disinfection will take place when the seat 145 is place in contact with overlying cover 141.

In an optional embodiment, the cleaning/disinfecting systems could be placed in basin ring 166 or simply be a layer 167 placed between toilet seat 145 and basin ring 166.

Figure 17:
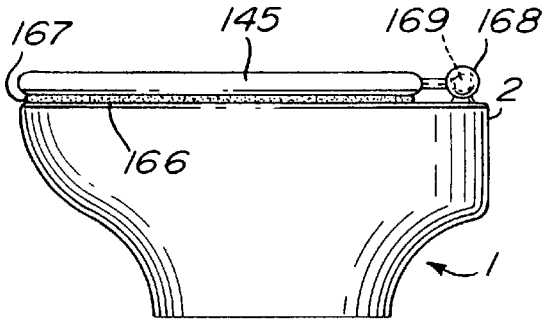
FIG. 17 is a side elevational view of a third embodiment of the toilet seat of the present invention comprising a reversible seat, a cover, and is an optional intermediary disinfecting layer.

Referring now to FIG. 17, seat 145 could be mounted on the frame 2 of toilet 1 using a ball joint 168 where the ball 169 is integral with seat 145. Of course other mountings such as rotary end caps (not shown) with slot openings (not shown) for easy detachment and side reversal of seat 145 are also contemplated. However, the ball joint arrangement is preferred. Seat 145 could therefore be reversible at will by rotating seat 145 in ball joint 168. One side of the reversible seat would always be cleaned/disinfected and ready for use whenever it would be held in contact with layer 167 or basin ring 166. A user need only reverse the seat 145 to get a clean/disinfected surface.

Although the present invention has been described hereinabove with reference to preferred embodiments thereof, these embodiments can be modified at will, within the scope of the appended claims, without departing from the spirit and nature of the subject invention.

For example, tilting operation of the cup 9 and/or maintaining cup 9 in a standby position can be effected as follows:

by a piston made of flexible rubber and supplied with water (hydraulic force);

by filling a reservoir of the cup 9 with water to translate the centre of gravity of the cup 9 and contents thereof and thereby cause tilting of that cup;

by displacing a weight again to translate the centre of gravity;

by means of a magnet or magnets (magnetic force);

through a spring;

by detecting the level of water in the bowl and activating an electric motor;

through a gear arrangement;

through detection of the presence of a user;

by remote control, etc.

It is within the scope of the present invention to use any manual, electric, electronic, mechanical, automatic, magnetic, gravity triggering for tilting the cup 9.

In the same manner, the valves 21, 43 and 74 can be triggered either manually, electrically, electronically, mechanically, automatically, magnetically, remotely or by gravity.

The level of water in the bowl 3 can be controlled by an independent valve situated inside or outside the sequential valve 43 or control valve device 74.

It is also within the scope of the present invention to provide a portable toilet including the concepts described in the foregoing description. Furthermore, it is contemplated that the portable toilet be provided with a foldable supply water container and optionally a foldable waste product container.

I claim:

1. A toilet comprising:

a frame defining a chamber, a toilet bowl disposed within said chamber between an upper chamber region and a lower chamber region, said toilet bowl having a lower discharge opening in communication between said upper chamber region and said lower chamber region, a tilting bowl disposed generally in said lower chamber region of said frame, said tilting bowl defining a fluid-receiving volume, said tilting bowl mounted for pivoting movement relative to said toilet bowl between a first position with said fluid-receiving volume at least partially overlapping said toilet bowl and containing said lower discharge opening, and a second position permitting flow of fluid from said toilet bowl, through said lower discharge opening, and from said fluid-receiving volume into said lower chamber region, said tilting bowl, in said first position, retaining a volume of fluid in said fluid-receiving volume sufficient to engage said lower discharge opening in a manner to restrict flow of gas therethrough, said tilting bowl adapted to remain in said first position when containing said volume of fluid below a first predetermined fluid level, and said tilting bowl adapted to move from said first position toward said second position in response to introduction of additional fluid into said fluid-receiving volume when fluid in said fluid-receiving volume exceeds a second predetermined fluid level, said second predetermined fluid level being relatively higher than said first predetermined fluid level.

2. The toilet of claim 1, wherein said tilting bowl is biased to return from said second position toward said first position.

3. The toilet of claim 1, further comprising a plurality of outlets disposed and arrayed to direct water in streams against an inner wall surface of said toilet bowl for cleaning action.

4. The toilet of claim 3, wherein said plurality of outlets are arrayed to define an enclosure region disposed generally above said lower discharge opening, said enclosure region casting a vertical projection view at least partially overlapping a vertical projection view of said lower discharge opening.

5. The toilet of claim 3, wherein said plurality of outlets are arrayed to define an enclosure region disposed generally above a waste water bottom discharge hole, said enclosure region casting a vertical projection view at least partially overlapping a vertical projection view of said waste water bottom discharge hole.

6. The toilet of claim 3, further comprising means for delivering water through said plurality of outlets, said means for delivering water being electronically controlled.

7. The toilet of claim 3 further comprising means for delivering water through said plurality of outlets, said means for delivering water comprising sequencing means for delivering water to successive sets of said plurality of outlets in sequence for improved cleaning action.

8. The toilet of claim 1, further comprising means for retarding return of said tilting bowl from said second position toward said first position.

9. The toilet of claim 8, wherein said means for retarding comprises at least one reservoir mounted to said tilting bowl, and means for delivering fluid into said at least one reservoir, said at least one reservoir, with said tilting bowl in said first position, containing a volume of fluid, and said at least one reservoir, upon movement of said tilting bowl from said first position toward said second position, adapted to release said volume of fluid over an interval of time, said tilting bowl mounted in a manner, upon release of said volume of fluid, to return toward said first position.

10. The toilet of claim 1, wherein said tilting bowl comprises a one-piece bowl pivoted about a substantially horizontal axis.

11. The toilet of claim 1, wherein said tilting bowl movement comprises means for restricting movement of said tilting bowl from said first position toward said second position.

12. The toilet of claim 11, wherein said means for restricting comprises a latch assembly.

13. The toilet of claim 1, wherein said tilting bowl movement comprises means for detecting when said second level has been achieved and releasing said tilting bowl for movement from said first position to said second position.

14. The toilet of claim 13, wherein said means for level detecting and movement releasing comprises a float and latch assembly.

* * * * *